US005224233A

United States Patent [19]

Rich

[11] Patent Number: 5,224,233

[45] Date of Patent: Jul. 6, 1993

[54] GOLF CLUB CLEANING DEVICE

[76] Inventor: Lawrence M. Rich, R.D. #2, Box 60, Derry, Pa. 15627

[21] Appl. No.: 984,969

[22] Filed: Dec. 3, 1992

[51] Int. Cl.[5] ..... A46B 13/02

[52] U.S. Cl. ..... 15/88.3; 15/75

[58] Field of Search ..... 15/21.1, 56, 70, 74, 15/75, 76, 88.2, 88.3

[56] References Cited

U.S. PATENT DOCUMENTS

| | | | |
|---|---|---|---|
| 2,104,272 | 1/1938 | Partridge | 15/76 |
| 4,009,499 | 3/1977 | Casler | 15/88.3 |
| 4,951,339 | 8/1990 | Braun | 15/88.3 |

*Primary Examiner*—Edward L. Roberts
*Attorney, Agent, or Firm*—Jon M. Lewis

[57] ABSTRACT

A machine for cleaning the heads of golf clubs includes a motordriven rotary brush which is submerged in a container of water or the like, the motor being located in a first housing section located outside of the container and the brush being carried by a shaft journaled in a second housing section located within the container, the two sections being connected at their upper ends by a third section housing the transmission between the motor and the brush shaft. The machine is supported by an adjustable ground-engaging support attached to the motor housing and by clamps which clamp the container wall to the side of the brush shaft housing.

8 Claims, 2 Drawing Sheets

GOLF CLUB CLEANING DEVICE

The present invention pertains to devices for washing golf clubs and, more particularly, to portable devices for cleaning the head portions of golf clubs.

BACKGROUND OF THE INVENTION

In use the heads of golf clubs become soiled with dirt, grass stains and the like, necessitating cleaning thereof. Such cleaning is normally done manually, as by wiping the club head with a moistened rag. At establishments that have large numbers of golf clubs such as golf courses and driving ranges where the clubs are rented to individual users, manual cleaning of the clubs can be a time-consuming process.

It is, accordingly, a primary object of the present invention to provide a machine for use in cleaning of golf clubs.

It is also an object of the present invention to provide such a golf club cleaning machine which is readily portable and which is characterized by its simplicity of operation.

SUMMARY OF THE INVENTION

The above and other objects of the invention which will become apparent hereinafter are achieved by the provision of a golf club cleaning device which includes a housing having a lateral extension at the upper end thereof; an electric motor within the housing; a rotary brush with a shaft, the upper end of the shaft being received in the housing extension; a power transmission connecting the shaft to the motor; and a ground-engaging support base attached to the housing so as to permit adjustment of the vertical position of the housing. The machine is used in conjunction with a conventional wash pail, the machine being positioned so that the brush is within the pail with the main housing and motor external to the pail, the support base being adjusted to place the housing extension directly above and close to the rim of the pail. A quantity of water or detergent solution is placed in the pail, the motor actuated and a golf club is manipulated so that the head thereof is submerged within the pail and scrubbed clean by the brush.

For a more complete understanding of the invention and the objects are advantages thereof, reference should be had to the accompanying drawings and the following detailed description wherein a preferred embodiment of the invention is illustrated and described.

DESCRIPTION OF THE PREFERRED EMBODIMENT

Figure 1:
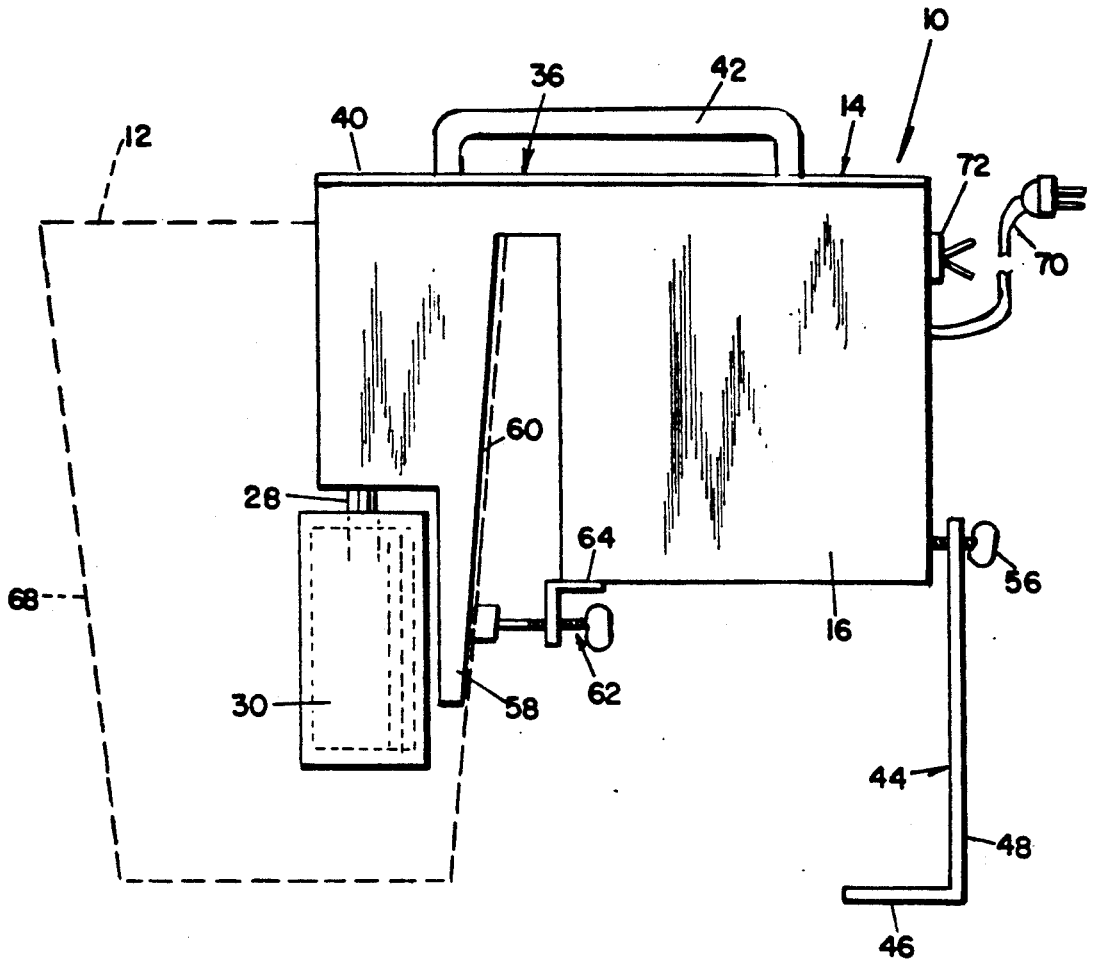
FIG. 1 is a side elevational view of the golf club cleaning machine of the present invention.
Figure 2:
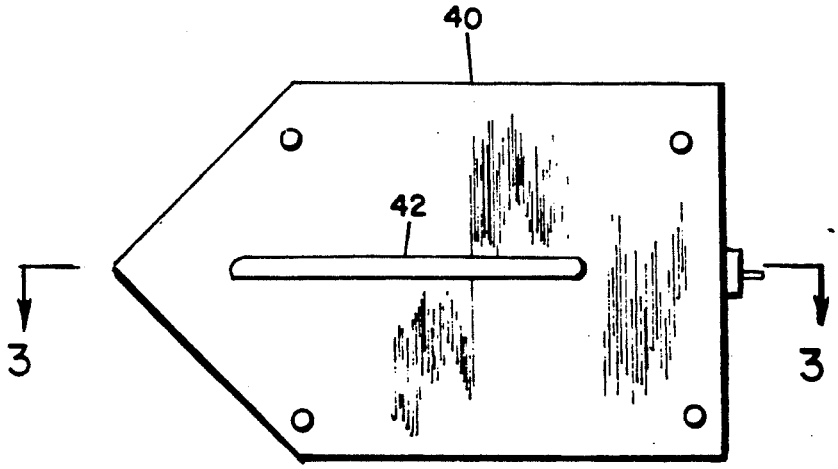
FIG. 2 is a top plan view thereof.
Figure 3:
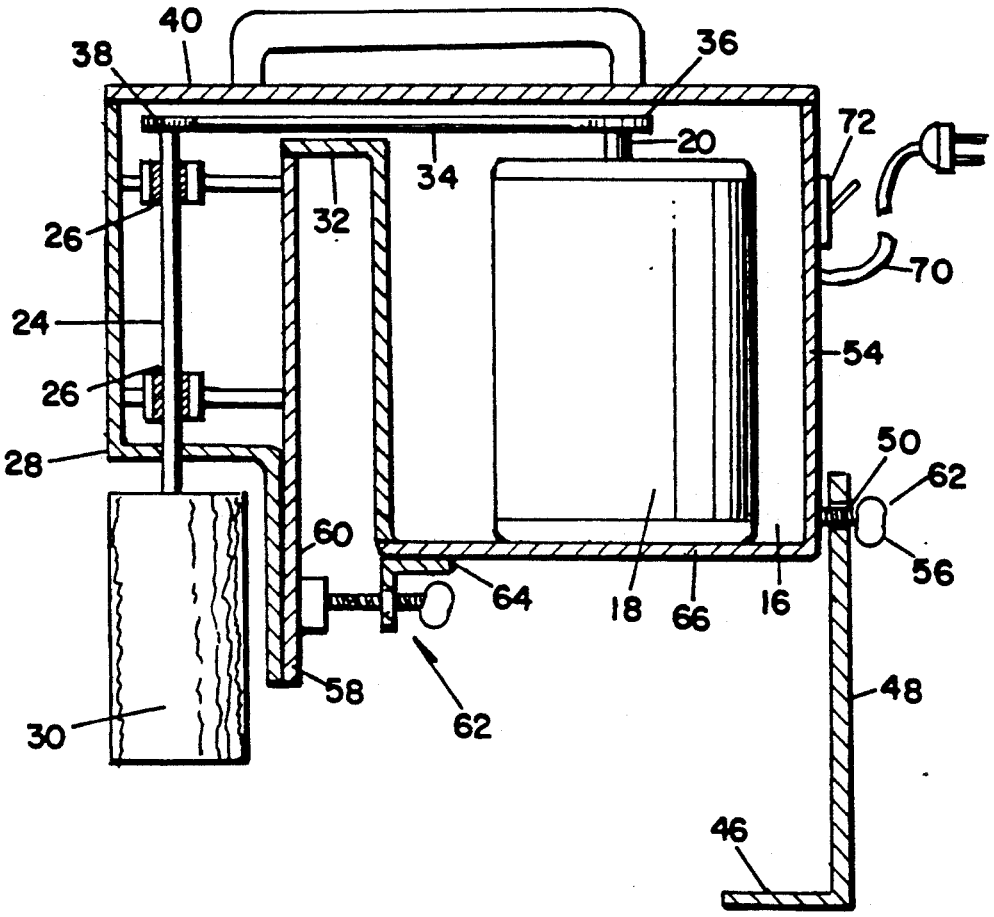
FIG. 3 is a transverse cross sectional view taken on the line 3—3 of FIG. 2.

The golf club cleaning machine, designated generally by the reference numeral 10, is used with a conventional bucket or wash pail 12. The machine includes a housing, designated generally by the numeral 14, which includes a first section 16 in which is housed an electric motor 18 having an output shaft 20 at its upper end, a second section 22 housing a vertical shaft 24 supported by bearings 26, the lower end of the shaft 28 extending downwardly from the housing section and mounting a rotary brush 30, and a third section 32 interconnecting the upper ends of the first and second sections. A drive mechanism, such as an endless belt 34 entrained over a drive pulley 36 mounted on the motor shaft 20 and a driven pulley 38 mounted on the vertical shaft 24, is contained within the third housing section 32. The top of the third section of the housing is closed by a removable cover plate 40, allowing access to the drive mechanism. This cover mounts a handle 42.

As is mentioned above, the machine 10 is used with a bucket 12. In order to support the machine, there is provided a support bracket 44 having a ground-engaging base 46 and a vertical standard 48 extending upwardly therefrom, the upper end of the standard having a vertically extending slotted opening 50 for receiving a screw 52 affixed in and projecting laterally from the side wall 54 of the motor housing section 14, a wing nut 56 serving to clamp the standard in the desired position.

The machine 10 is stabilized with respect to the bucket by being clamped thereto. To this end, the shaft housing section 22 includes a lower portion 58 extending downwardly immediately beside the upper end of the brush 30 and with the side face 60 thereof remote from the brush being of curved configuration generally complementary to the curvature of the bucket. A pair of adjustable clamping members 62 carried by brackets 64 attached to the bottom wall 66 of the motor housing section 14 cooperate with the face 60 of the shaft housing extension 58 to clamping engage the side wall 68 of the bucket.

Completing the description of the machine 10, a power cord 70 is provided for connecting the motor to a power source. Preferably, an On/Off switch 72 is also provided.

Use of the machine 10 involves adjusting the position of the support bracket 44 with respect to the bucket with which the machine is used so that the underside of the third housing section 32 extends across the upper rim of the bucket and adjusting the clamping members 62 to clamp the side wall of the bucket between these members and the face 60 of the shaft housing extension 58. A quantity of water, or a suitable detergent solution, is added to the bucket and the motor 18 actuated to rotate the brush 30. When the head of a golf club is submerged in the bucket, it is cleaned both by the swirling action of the liquid and by direct contact with the rotating brush.

It will be apparent that the present invention provides a golf club machine of simple design which is easily used and which is effective for the cleaning of golf club heads.

While a preferred embodiment of the invention has been illustrated and described in detail herein, it will be understood that changes and additions may be had therein and thereto without departing from the spirit of the invention. Reference should, accordingly, be had to the appended claims in determining the true scope of the invention.

What is claimed is:

1. A golf club cleaning machine comprising:

a first housing section having side and bottom walls;

an electric motor housed within said first housing section said motor having an output shaft located at the upper end of said first housing section;

a second housing section having side and bottom walls;

a second shaft journaled in said second housing, said shaft having a first end located at the upper end of said second housing section and a second end extending through said bottom wall of said second housing section;

a third housing section interconnecting said first and second housing sections at the upper ends thereof with the adjacent side walls of said first and second housing sections in spaced relation to one another;

a transmission mechanism within said third housing section drivingly connecting said motor output shaft to said second shaft;

a rotary brush connected to said second end of said second shaft for rotation therewith;

ground-engaging support means adjustably connected to said first housing section; and adjustable clamping means attached to said first housing section and cooperating with said adjacent wall of said second housing section to clamp a container wall interposed between said first and second housing sections.

2. The golf club cleaning machine of claim 1 wherein said third housing section includes a carrying handle for said machine.

3. The golf club cleaning machine of claim 1 wherein said adjacent side wall of said second housing section extends downwardly beyond said adjacent side wall of said first housing section and wherein said clamping means is attached to said bottom wall of said first housing section and cooperates with the lower end of said adjacent side wall of said second housing section;

4. The golf club cleaning machine of claim 3 wherein said said adjacent side wall of said second housing section is of curved configuration and extends laterally of the upper portion of said rotary brush.

5. A golf club cleaning machine for use with an open-top container to cleaning golf club heads immersed in liquid in said container comprising:

a first housing section having a top end and side and bottom walls;

an electric motor contained within said first housing section and including an output shaft at said top end thereof;

a second housing section having a top end and side and bottom walls;

a second shaft journaled within said housing section and having a first end at the upper end thereof and a second end extending through said bottom wall thereof;

a rotary brush attached to said second end of said second shaft for rotation therewith;

a third housing section interconnecting said first and second housing sections at the said upper ends thereof, a side wall of the container being receivable between adjacent portions of said side walls of said first and second housing sections;

transmission means within said third housing section connecting said output shaft to said second shaft;

adjustable ground-engaging support means attached to said first housing section; and adjustable clamping means attached to said first housing section and cooperating with said adjacent side wall of said second housing section to clamp the container side wall therebetween.

6. The golf club cleaning machine of claim 5 wherein said adjacent side wall of said second housing section is of curved configuration and includes a lower portion extending below said bottom wall of said second housing section and said bottom wall of said first housing section, said clamping means being mounted on said bottom wall of said first housing section and cooperating with said lower portion.

7. The golf club cleaning machine of claim 6 wherein said lower portion is adjacent to the upper portion of said rotary brush.

8. The golf club cleaning machine of claim 5 wherein said third housing section includes a carrying handle.

* * * * *